US010681468B2

(12) United States Patent
Okazaki et al.

(10) Patent No.: US 10,681,468 B2
(45) Date of Patent: Jun. 9, 2020

(54) SPEAKER DIAPHRAGM AND COIL COUPLING ARRANGEMENT, AND METHOD

(71) Applicant: Yamaha Corporation, Hamamatsu, Shizuoka (JP)

(72) Inventors: Koji Okazaki, Shizuoka (JP); Masahiro Tobise, Shizuoka (JP)

(73) Assignee: YAMAHA CORPORATION, Hamamatsu, Shizuoka (JP)

( * ) Notice: Subject to any disclaimer, the term of this patent is extended or adjusted under 35 U.S.C. 154(b) by 0 days.

(21) Appl. No.: 15/661,381

(22) Filed: Jul. 27, 2017

(65) Prior Publication Data

US 2019/0037318 A1 Jan. 31, 2019

(51) Int. Cl.

| | |
|---|---|
| ***H04R 25/00*** | (2006.01) |
| ***H04R 9/06*** | (2006.01) |
| ***H04R 9/02*** | (2006.01) |
| ***H04R 7/12*** | (2006.01) |
| ***H04R 7/18*** | (2006.01) |
| ***H04R 9/04*** | (2006.01) |
| *H04R 31/00* | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 9/045* (2013.01); *H04R 7/125* (2013.01); *H04R 31/003* (2013.01); *H04R 2400/11* (2013.01)

(58) Field of Classification Search

CPC . H04R 9/06; H04R 7/127; H04R 7/18; H04R 9/025; H04R 2400/11

USPC ..... 381/398

See application file for complete search history.

(56) References Cited

U.S. PATENT DOCUMENTS

| | | | | |
|---|---|---|---|---|
| 2,084,945 A * | 6/1937 | Cornwell | ..... | H04R 7/122 181/165 |
| 4,817,165 A | 3/1989 | Amalaha | | |
| 5,497,428 A * | 3/1996 | Rojas | ..... | H04R 9/022 381/414 |
| 5,903,076 A * | 5/1999 | Suyama | ..... | B06B 1/045 310/81 |
| 7,190,804 B2 | 3/2007 | Nakamura et al. | | |

(Continued)

FOREIGN PATENT DOCUMENTS

| | | |
|---|---|---|
| JP | S60-185498 A | 9/1985 |
| JP | 4323881 B2 | 9/2009 |
| JP | 4764162 B2 | 8/2011 |

OTHER PUBLICATIONS

Office Action in the corresponding European Patent Application No. 18 184 243.6, dated Jan. 7, 2020.

(Continued)

*Primary Examiner* — Phylesha Dabney

(74) *Attorney, Agent, or Firm* — Global IP Counselors, LLP

(57) ABSTRACT

A speaker comprising a diaphragm including a first layer defining a coil receiving opening therein, and a second layer attached to the first layer and traversing the coil receiving opening. The speaker further comprises a coil having an end extending into the coil receiving opening and abutting against a surface of the second layer that traverses the coil receiving opening. Thus, transmission efficiency between the coil and diaphragm is improved, which improves the audio quality of the speaker.

15 Claims, 8 Drawing Sheets

(56) References Cited

U.S. PATENT DOCUMENTS

| | | | | |
|---|---|---|---|---|
| 8,045,746 | B2 | 10/2011 | Takayama et al. | |
| 9,204,221 | B2 * | 12/2015 | Wen | H04R 7/122 |
| 2009/0003644 | A1 * | 1/2009 | Furuya | H04R 9/02 381/400 |
| 2015/0010197 | A1 * | 1/2015 | Kawata | H04R 7/125 381/412 |
| 2015/0075900 | A1 * | 3/2015 | Yuen | H04R 7/125 181/168 |

OTHER PUBLICATIONS

Extended European Search Report of the corresponding European Patent Application No. 18184243.6, dated Nov. 13, 2018.

* cited by examiner

SPEAKER DIAPHRAGM AND COIL COUPLING ARRANGEMENT, AND METHOD

BACKGROUND

Field of the Invention

The present invention relates to a speaker diaphragm and coil coupling arrangement and method. More particularly, the present invention relates to speaker diaphragm having first and second layers, and a coil receiving opening defined in the first layer which enables a coil to abut against a surface of the second layer that traverses the coil receiving opening.

Description of the Related Art

In a typical audio speaker, a coil and a diaphragm are attached to each other by an adhesive. Conventional speaker diaphragms are typically constructed of a single material such as aluminum or paper, although some speaker diaphragms can be made of multiple layers of different materials. Conventionally, a speaker diaphragm made of a single material can be structured to have a hole that passes entirely through the diaphragm, with the coil extending into the hole and attached by an adhesive to the edges defining the hole. In this arrangement, a gap exist between the coil and the diaphragm, and the adhesive fills the gap to connect the coil and diaphragm together.

Also, a speaker diaphragm made of different materials can have a solid back surface material, in which case the coil can be attached by adhesive to the solid back surface material. Although this may reduce the size of the gap between the coil and the diaphragm itself, the adhesive is present between the coil and the diaphragm. Also, the solid back surface material is present between the coil and the outer material of the diaphragm from which sound waves are emitted.

SUMMARY

The gap between the coil and the diaphragm, along with the presence of adhesive in the gap, can reduce the transmission efficiency of the vibration energy from the coil to the diaphragm. Also, in multi-layered speaker diaphragms, the solid back surface material can reduce transmission efficiency of the vibration energy from the coil to the fiber layer of the speaker diaphragm, thus negatively impacting audio quality.

In view of these problems, an embodiment of the present invention provides a speaker comprising a diaphragm including a first layer defining a coil receiving opening therein, and a second layer attached to the first layer and traversing the coil receiving opening. The speaker further comprises a coil having an end extending into the coil receiving opening and abutting against a surface of the second layer that traverses the coil receiving opening. Thus, transmission efficiency between the coil and diaphragm is improved, which improves the audio quality of the speaker.

BRIEF DESCRIPTION OF THE DRAWINGS

Referring now to the attached drawings which form a part of this original disclosure.

Figure 1:
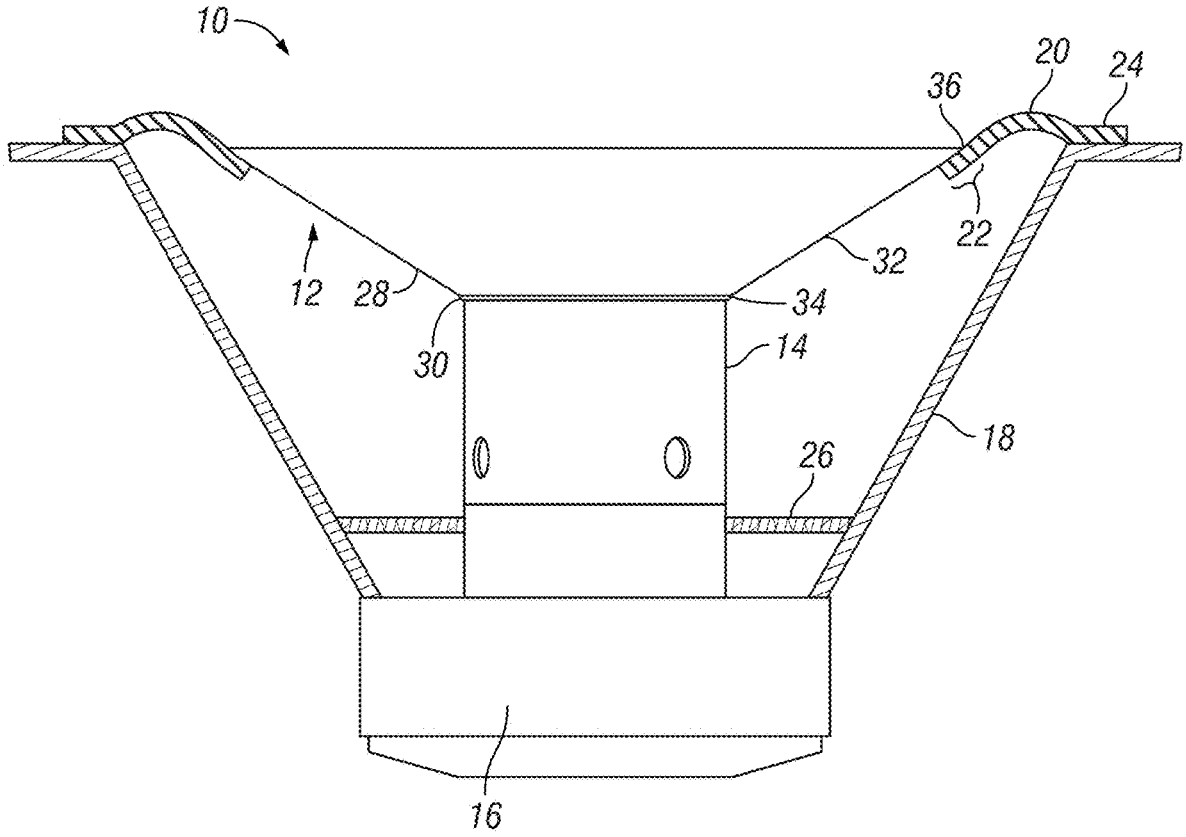
FIG. 1 is a side elevational view of a speaker according to a disclosed embodiment, with a portion of the speaker frame cut away.

It should be noted that these figures are intended to illustrate the general characteristics of methods and structure utilized in the illustrative embodiment and to supplement the written description provided below. These drawings may not precisely reflect the precise structural or performance characteristics of any given embodiment, and should not be interpreted as defining or limiting the range of values or properties encompassed by illustrative embodiments unless specified.

DETAILED DESCRIPTION OF EMBODIMENTS

Selected embodiments will now be explained with reference to the drawings. It will be apparent to those skilled in the music field from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features may be omitted in later embodiments.

As shown in FIG. 1, a speaker 10 according to a disclosed embodiment includes a diaphragm 12, a coil 14 and a magnet 16 that are mounted to a speaker frame 18. The diaphragm 12 can be attached to the speaker frame 18 by, for example, a surround 20 which is typically made of rubber and has a roll shape as understood in the art. In a typical example, the surround 20 has a first end 22 that is attached to the diaphragm 12, and a second end 24 that is attached to the speaker frame 18, by any suitable type of glue, paste, adhesive or fastener, or in any suitable manner as understood in the art. The coil 14, which can be referred to as a voice coil, can also be attached to the speaker frame 18 by a flexible suspension 26, which is commonly referred to as a spider and made of a flexible material such as a corrugated fabric, or in any suitable manner as understood in the art. The coil 14 also has a wire winding (not shown) wrapped around a portion of the exterior of the coil as with a conventional coil, and is coupled to, for example, a terminal board (not shown) as understood in the art. The magnet 16 is mounted to the speaker frame 18 by any suitable type of mounting structure as understood in the art.

The diaphragm 12 in this example includes a first layer 28 that is made of a material, such as paper, as understood in the material arts, especially with regard to materials used for construction of a speaker. The first layer 28 also defines a coil receiving opening 30 therein. The first layer 28, and thus the diaphragm 12, further includes a radially extending portion 32 that extends symmetrically outward from the coil receiving opening 30. The coil receiving opening 30 in this example is defined at a central location or a substantially central location of the diaphragm 12. However, the coil receiving opening 30 need not be located at the center of the diaphragm 12, especially when the diaphragm 12 is configured to have an asymmetrical shape.

In this example, the radially extending portion 32 extends in a hemispherical or conical shape outward from an edge 34 defining the coil receiving opening 30 to an outer edge 36. Also in this example, the outer edge 36 is configured as a circular outer edge 36. However, the radially extending portion 32, and thus the outer edge 36, can have any suitable shape as understood in the art. For instance, the radially extending portion 32 can extend asymmetrically outward to the outer edge 36 which has an oval shape, or any other non-circular shape.

Figure 2:
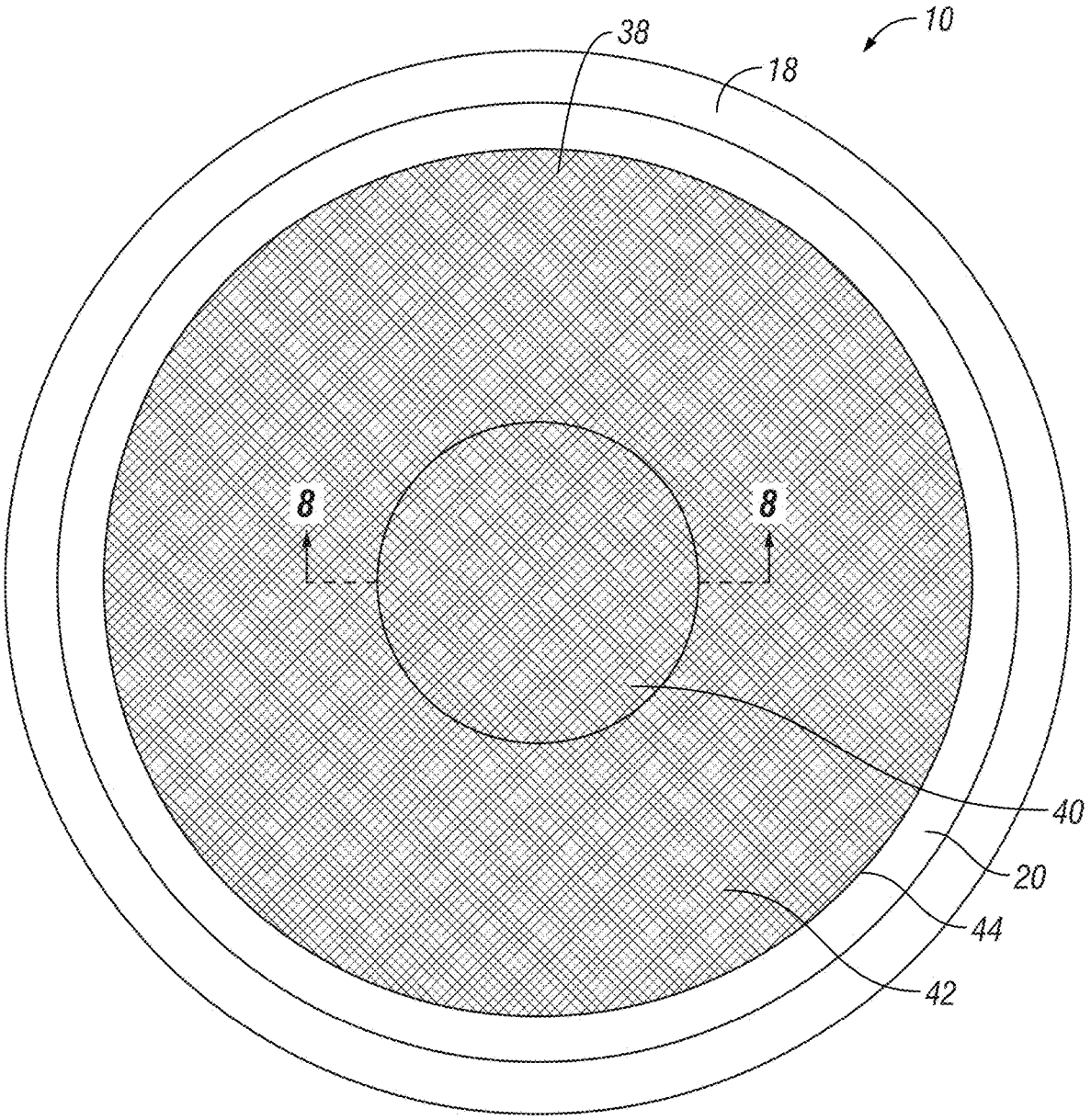
FIG. 2 is a front plan view of the speaker.

As further shown in FIG. 2, the diaphragm 12 in this example includes a second layer 38 that is attached to the first layer 28 by any suitable type of glue, paste or adhesive, or in any other suitable manner as understood in the art. However, the diaphragm 12 can include any suitable number of layers that are attached together by an adhesive or in any suitable manner.

Efforts can be made to optimize the stiffness and the weight of a speaker diaphragm 12 to achieve ideal acoustic properties. Thus, the second layer 38 can be made of, for example, a high-intensity material, such as a poly(p-phenylene-2,6-benzobisoxazole) fiber, which is commonly referred to as a PBO fiber and also known as ZYLON®, or any other suitable material as understood in the art. The second layer 38 thus can function as the outer layer of the speaker diaphragm 12 from which sound waves are emitted. The material (e.g., paper) of the first layer 28 has a first stiffness smaller than a second stiffness of the material (e.g., ZYLON®) of the second layer 38. However, the first layer 28 in this example can have a suitable thickness so that the first layer 28 as a whole has less flexibility than the second layer 38 as a whole. Therefore, the first layer 28 provides rigidity and stability to the speaker diaphragm 12. In particular, the material (e.g., paper) of the first layer 28 and the material (e.g., ZYLON®) of the second layer 38, and the respective thicknesses of the first layer 28 and the second layer 38, are selected so that the speaker diaphragm 12 as a whole has a stable form, and has the desired characteristics of weight, stiffness and internal losses. The second layer 38 includes a central portion 40, and a radially extending portion 42 that extends symmetrically outward from the central portion 40. In this example, the radially extending portion 42 extends in a hemispherical or conical shape outward from the central portion 40 to an outer edge 44. Also in this example, the central portion 40 is configured as a circular central portion 40, and the outer edge 44 is configured as a circular outer edge 44. However, the central portion 40, the radially extending portion 42, and the outer edge 44 can have any suitable shape as understood in the art. For instance, the central portion 40 can have an oval shape, and the radially extending portion 42 can extend asymmetrically outward to the outer edge 44 which can have an oval shape, or any other non-circular shape. In this example, the outer edge 44 of the second layer 38 aligns with or substantially aligns with the outer edge 36 of the first layer 28.

Figure 3:
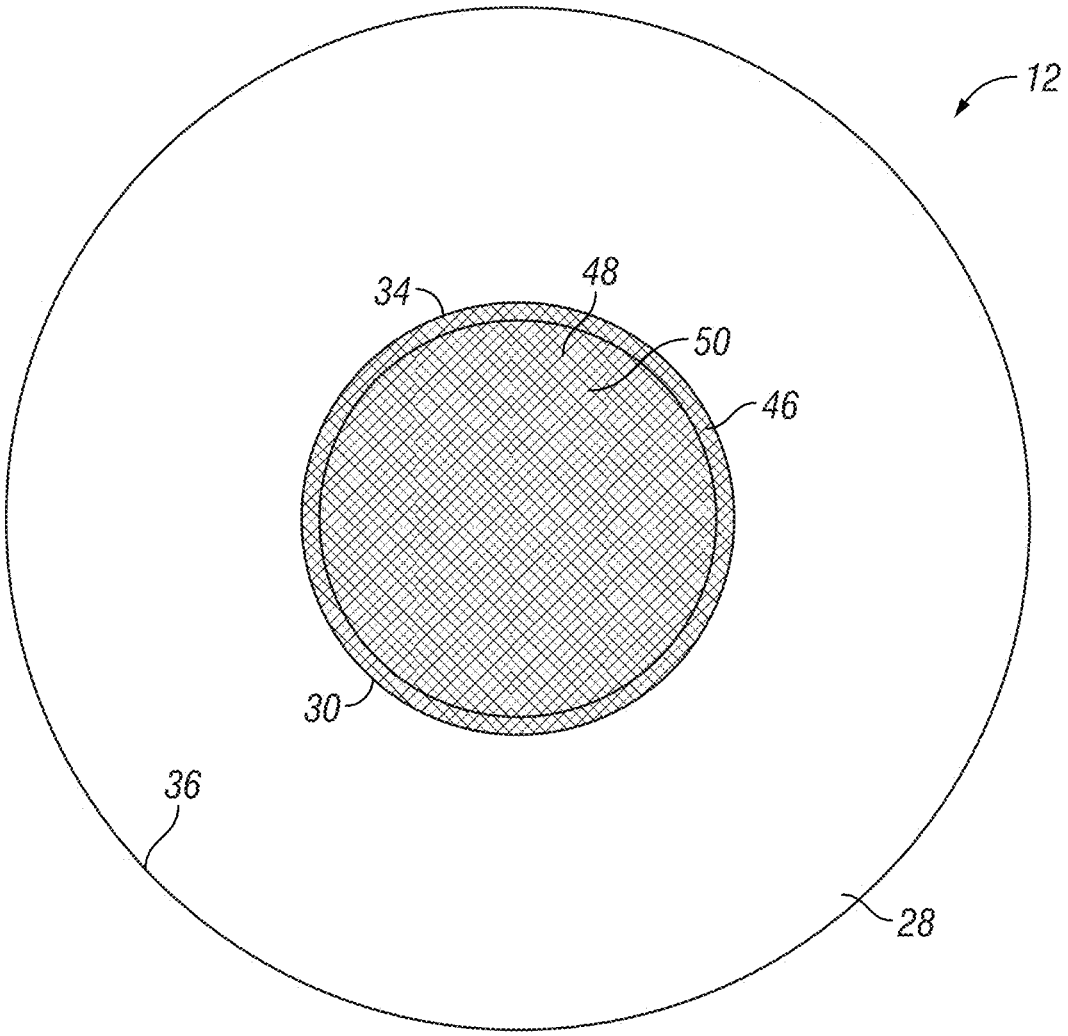
FIG. 3 is a rear plan view of the diaphragm without the coil.

As shown in FIG. 3, the second layer 38 includes a coil contacting portion 46 that is on the opposite side of the central portion 40. The coil contacting portion 46 has a surface 48 which traverses the coil receiving opening 30 and is discussed in more detail below. For example, as shown in FIG. 4, the coil contacting portion 46 can be configured to include a protruding portion 50, such as a convex shaped protruding portion 50, that protrudes out of the coil receiving opening 30 while traversing the coil receiving opening 30 as discussed in more detail below.

Figure 4:
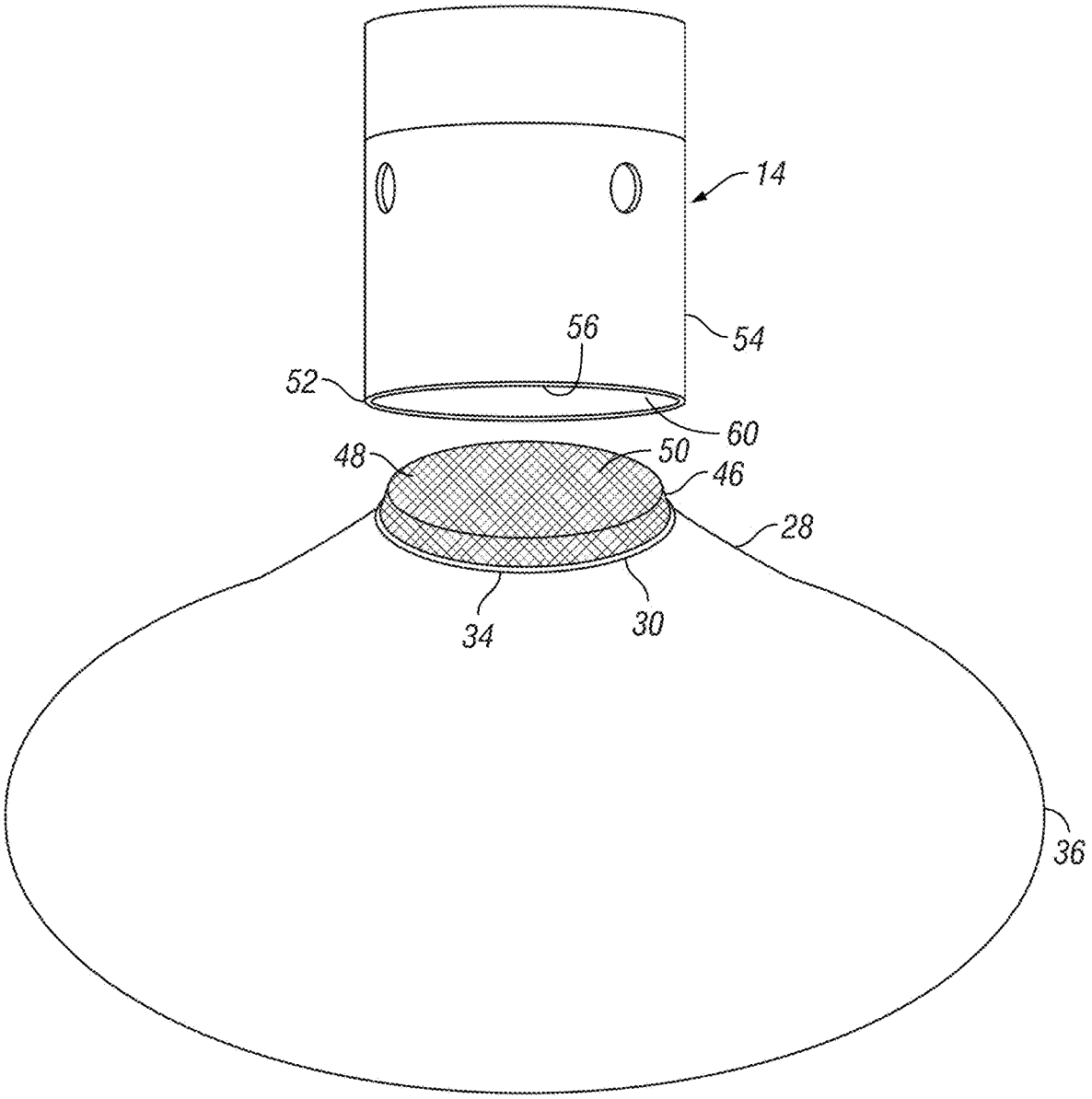
FIG. 4 is a rear perspective view of the diaphragm and coil with the coil separated from the diaphragm.

As further illustrated in FIG. 4, the coil 14 includes an end 52 that extends into the coil receiving opening 30 and abuts against the surface 48 of the second layer 38 that traverses the coil receiving opening 30. In this example, the coil receiving opening 30 is circular or substantially circular. Therefore, the end 52 of the coil 14 is cylindrical or substantially cylindrical, and has an outer surface 54 defining an outer diameter that is about the same or slightly smaller than the diameter of the coil receiving opening 30, so that the end 52 extends into the coil receiving opening 30. Thus, the end 52 includes an edge surface 56 that abuts against the surface 48 of the second layer 38 that traverses the coil receiving opening 30. In this example, the thickness of the wall of the coil 14, and thus the thickness of the end 52 and the edge surface 56, can be in a range of 0.03 mm to 0.2 mm, or any other suitable dimensions as understood in the art. At least a portion of the edge surface 56 directly contacts the surface 48 of the second layer 38.

Figure 5:
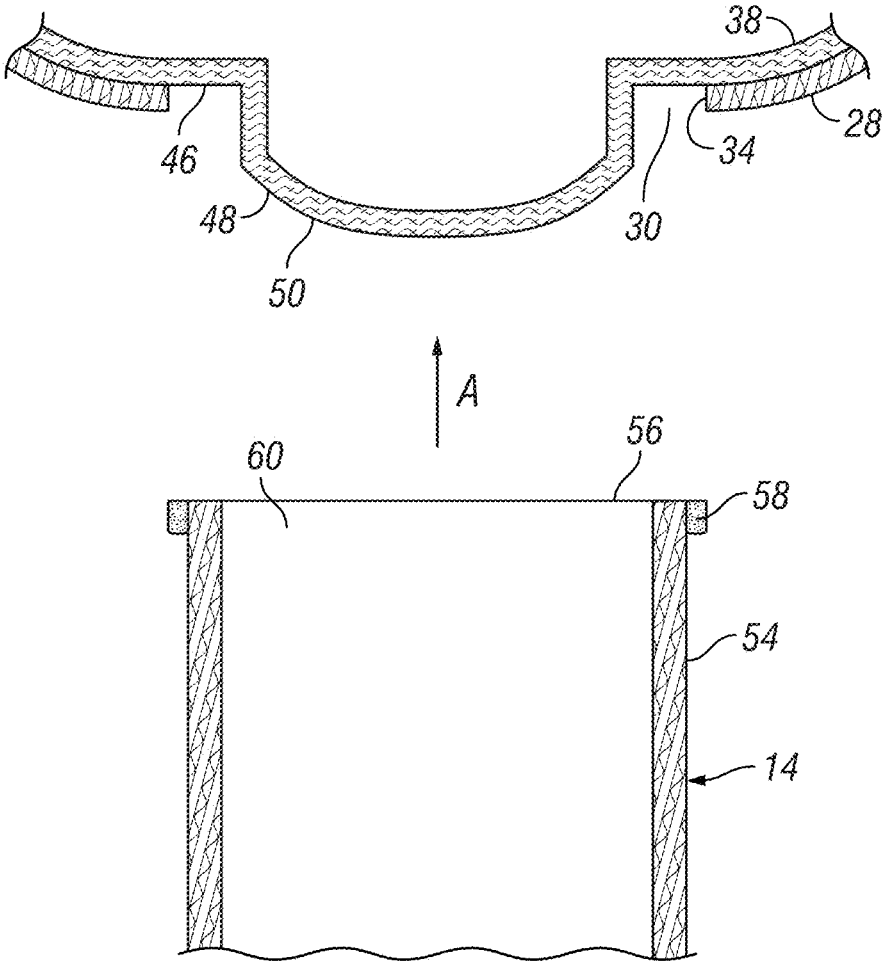
FIG. 5 is a cross-sectional view illustrating an example of assembly of the coil to the diaphragm.

Hence, the diaphragm 12 can be mounted to the speaker frame 18 via the surround 20, and the coil 14 can be mounted to the speaker frame 18 via the flexible suspension 26, such that the end 52 of the coil 14 extends into the coil receiving opening 30 and abuts against the surface 48 of the second layer 38 that traverses the coil receiving opening 30. FIG. 5 illustrates an example of the manner in which the coil 14 is attached to the diaphragm 12, with the end 52 of the coil 14 being attached to the edge 34 of the first layer 28 defining the coil receiving opening 30. For example, an adhesive 58 can be applied to the outer surface 54 to attach the outer surface 54 of the end 52 of the coil 14 to the edge 34 of the first layer 28 defining the coil receiving opening 30. Because the edge surface 56 has a small thickness as discussed above, the edge surface 56 acts as a knife edge while the end 52 is being inserted into the coil receiving opening 30 as the coil 14 is being pressed together with the diaphragm 12, thus pushing the adhesive 58 away from the surface 48 of the second layer 38 and away from an opening 60 in the coil 14. In any event, care is taken during assembly so that no adhesive 58, or at most very little adhesive 58, seeps between any portion of the surface 48 of the second layer 38 and the outer surface 54 of the end 52 of the coil 14 that abuts against the surface 48, or into the opening 60 in the coil 14. Nevertheless, since the material of the second layer 38 is porous, adhesive 58 that may seep between the surface 48 of the second layer 38 and the edge surface 56 of the end 52 of the coil 14 can be absorbed by the material of the second layer 38, so that most or at least some of the edge surface 56 remains directly in contact with the surface 48 of the second layer 38.

Figure 6:
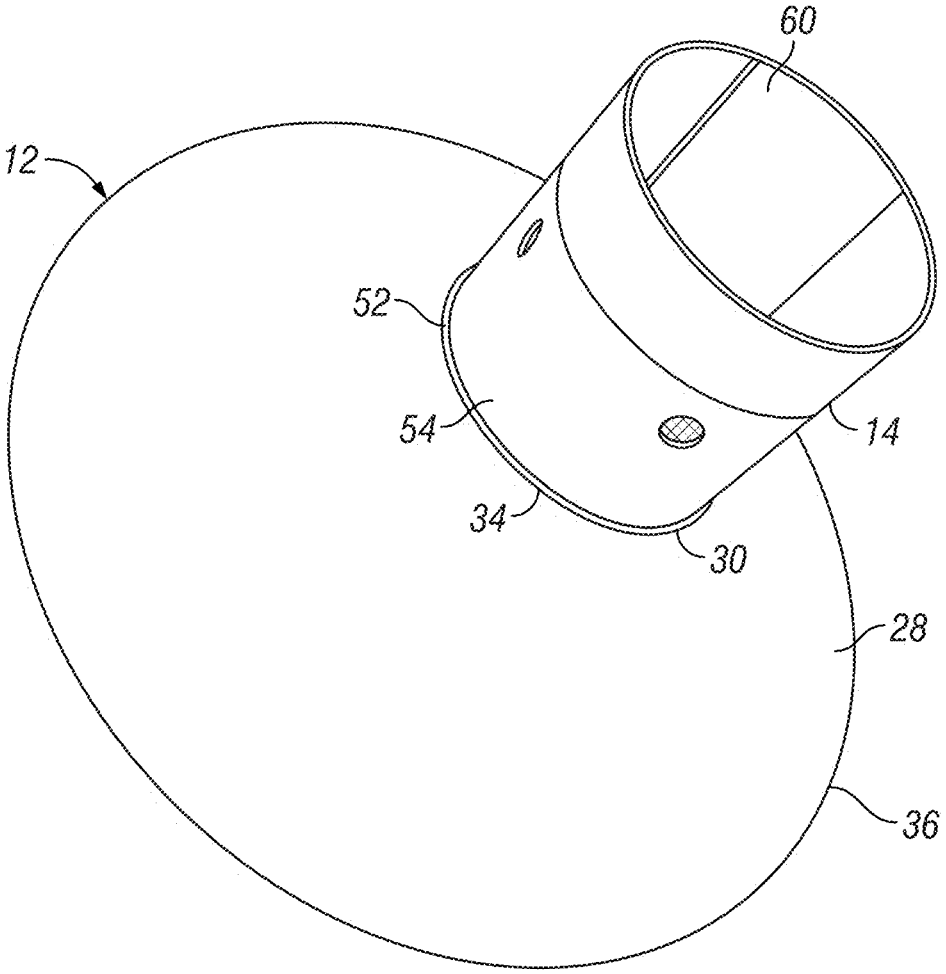
FIG. 6 is a rear perspective view of an example of the coil attached to the diaphragm of the speaker.
Figure 7:
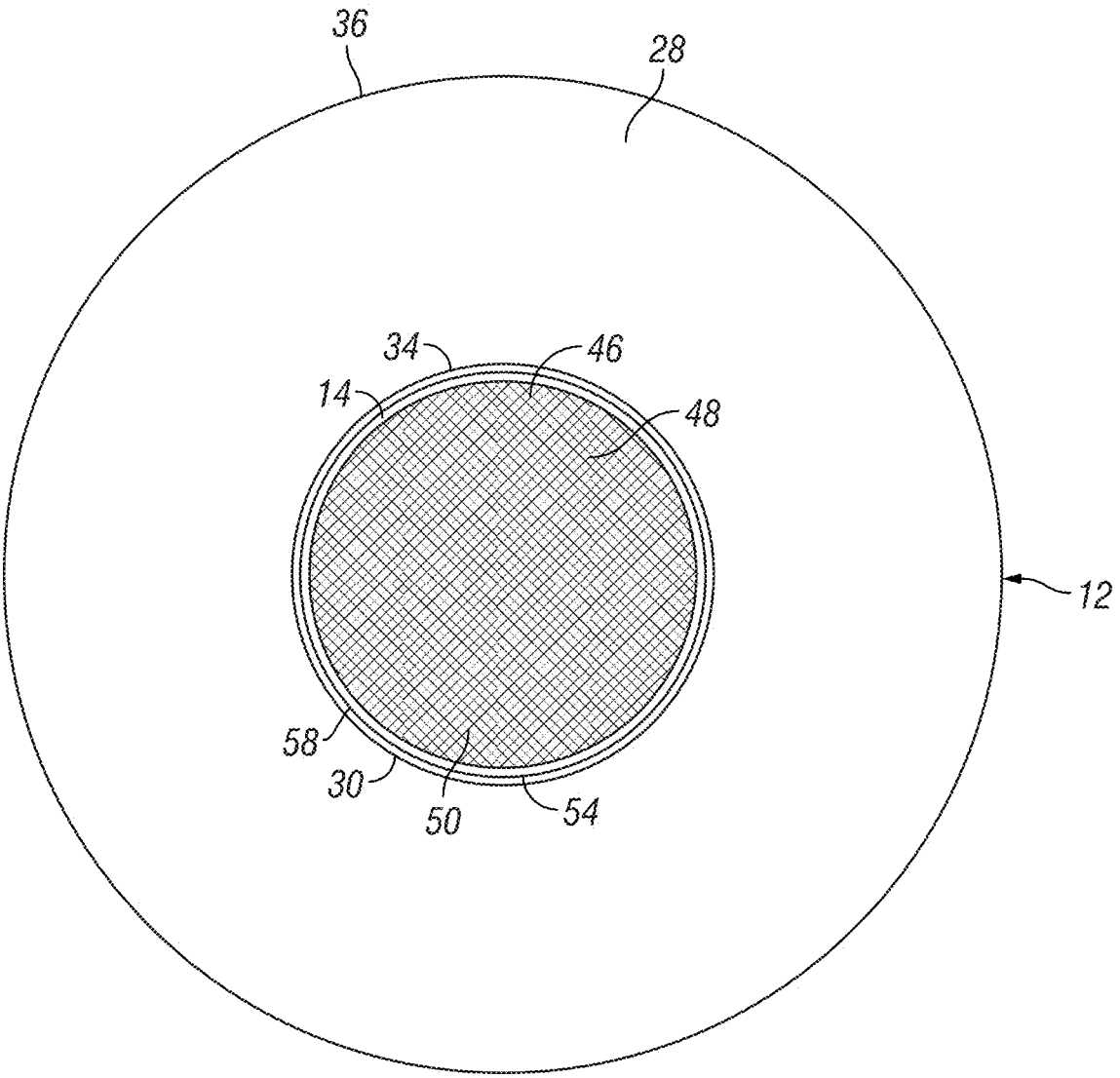
FIG. 7 is a rear plan view of the diaphragm and coil with the coil attached to the diaphragm.
Figure 8:
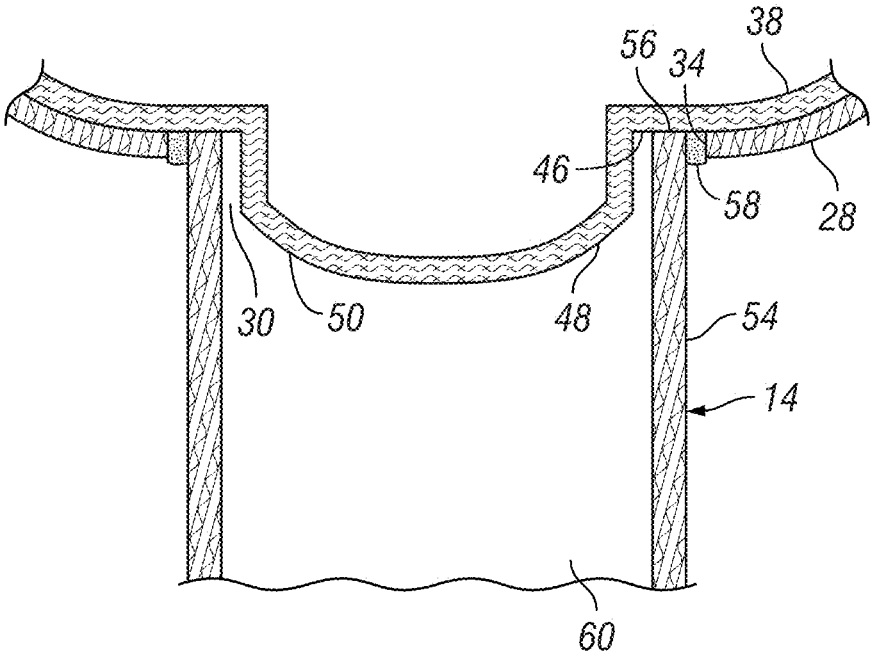
FIG. 8 is a detailed cross-sectional view of the speaker as taken along lines 8-8 in FIG. 2 and illustrating a protruding portion of the diaphragm extending into the coil.

Thus, as shown in the rear perspective view of FIG. 6, the coil 14 is securely mounted to the diaphragm 12, with the end 52 of the coil 14 firmly secured into the coil receiving opening 30. As can further be appreciated from FIG. 7, the coil 14 is attached to the diaphragm 12 with the adhesive 58 between the edge 34 defining the coil receiving opening 30 and the outer surface 54 of the end 52 of the coil 14. As can also be appreciated from the detailed cross-sectional view shown in FIG. 8, the edge surface 56 remains directly in contact with the surface 48 of the second layer 38. Also, the protruding portion 50 of the coil contacting portion 46 of the second layer 38 protrudes out of the coil receiving opening 30 and into the opening 60 in the coil 14.

Accordingly, the assembly of the coil 14 to the diaphragm 12 as described herein eliminates a gap between the diaphragm 12 and the coil 14, such as in conventional arrangements having an opening entirely through their single-layer diaphragm. Moreover, the assembly of the coil 14 to the diaphragm 12 as described above avoids the presence of the stiff backing material between the coil and outer layer in conventional multi-layered speaker diaphragms, thus improving audio quality. That is, as understood in the art, the surface of a speaker diaphragm 12 acts as an interfacial boundary to emit sound waves into the surrounding environment, such as air. The material and physical properties of the diaphragm 12, and especially the surface of the diaphragm 12, can have a substantial effect on the characteristics of the emitted sound waves, and thus can have a substantial effect on tones and audio quality. A reduction in transmission efficiency of the vibration energy from the coil 14 to the diaphragm 12 can negatively impact audio quality. The embodiments described herein thus eliminate or at least minimize any such reduction in transmission efficiency to improve audio quality.

Figure 9:
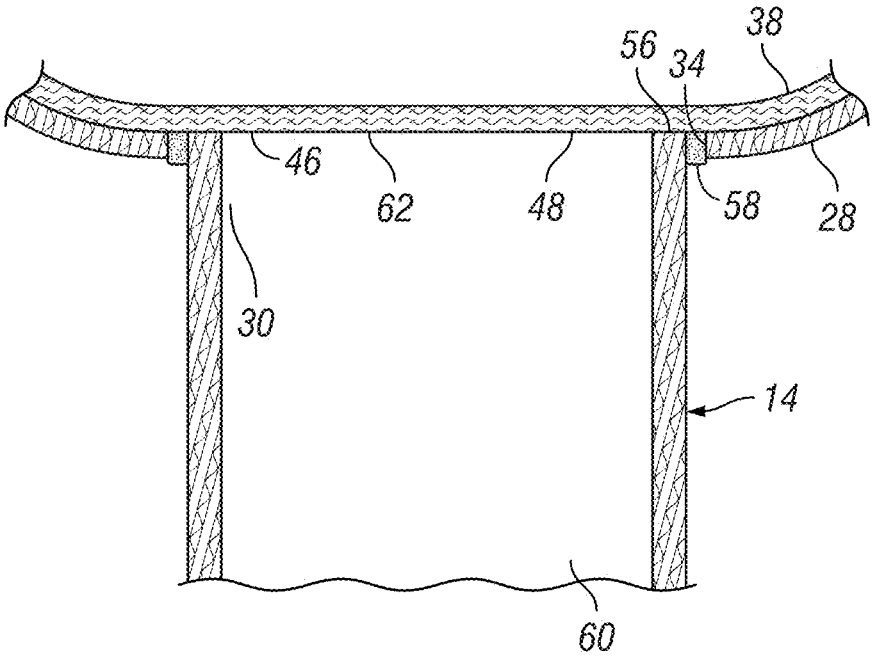
FIG. 9 is a detailed cross-sectional similar to that shown in FIG. 8, but with the diaphragm modified to include a substantially planar portion extending across the coil.

Alternatively, in another configuration of the second layer 38 as shown in FIG. 9, the coil contacting portion 46 can include a planar or substantially planar portion 62 instead of the protruding portion 50. In this configuration, the dimensions of the planar or substantially planer portion 62 can correspond to those of the central portion 40 of the second layer 38 as discussed above, such that the radially extending portion 42 of the second layer 38 can extend symmetrically or asymmetrically outward from the planar or substantially planar portion 62. The coil 14 is assembled to the diaphragm 12 in the manner described above, so that the edge surface 56 of the end 52 of the coil 14 is in direct contact with the surface 48 of the second layer 38. Thus, this configuration also achieves the benefits discussed herein.

As can be appreciated from the description herein, the speaker 10 having direct contact between the coil 14 and the second layer 38 of the diaphragm 12 minimizes, or basically eliminates, transmission or propagation loss of the vibration energy from the coil 14 to the second layer 38 of the diaphragm 12. Therefore, the audio quality of the speaker 10 is improved over conventional speakers. Furthermore, since the transmission loss is minimized or substantially eliminated, the second layer 38 of the diaphragm 12 is capable of regenerating even very minute audio signals more effectively than conventional speakers. Therefore, the speaker 10 is particularly suitable for use in high-end Hi-Fi speaker systems as understood in the art.

General Interpretation of Terms

In understanding the scope of the present invention, the term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A speaker comprising:

a diaphragm including a first layer having an inner edge defining a coil receiving opening, an outer edge spaced from the inner edge, and an extending portion connecting the inner edge and the outer edge, and a second layer attached to the first layer, the second layer having a central portion extending across the coil receiving opening, an outer edge spaced from the central portion, and an extending portion connecting the central portion and the outer edge of the second layer, the central portion traversing the coil receiving opening, the outer edge of the second layer being substantially adjacent to the outer edge of the first layer; and a coil having an end extending into the coil receiving opening and abutting against a surface of the second layer that extends across the coil receiving opening and traverses the coil receiving opening.

2. The speaker according to claim 1, wherein the end of the coil is attached to the inner edge of the first layer defining the coil receiving opening.

3. The speaker according to claim 2, further comprising an adhesive that attaches the end of the coil to the inner edge of the first layer defining the coil receiving opening.

4. The speaker according to claim 1, wherein the second layer comprises a substantially planar portion that extends across the coil receiving opening and traverses the coil receiving opening.

5. The speaker according to claim 1, wherein the second layer comprises a protruding portion that protrudes into the coil receiving opening while extending across the coil receiving opening and traversing the coil receiving opening.

6. The speaker according to claim 5, wherein the protruding portion is convex shaped.

7. The speaker according to claim 1, wherein the diaphragm includes a substantially planar portion having the coil receiving opening defined therein, and a conical portion extending outward from the substantially planar portion.

8. The speaker according to claim 1, wherein the first layer comprises a first material and the second layer comprises a second material different from the first material.

9. The speaker according to claim 8, wherein the first material has a first stiffness and the second material has a second stiffness different from the first stiffness.

10. The speaker according to claim 9, wherein at least the second stiffness is in excess of a stiffness value.

11. The speaker according to claim 9, wherein the second stiffness is greater than the first stiffness.

12. The speaker according to claim 1, wherein the coil receiving opening is defined at a central location of the diaphragm.

13. The speaker according to claim 1, further comprising a speaker frame and a surround which mounts the diaphragm to the speaker frame.

14. A speaker comprising:

a diaphragm including a first layer having an inner edge defining a coil receiving opening, an outer edge spaced from the inner edge, and an extending portion connecting the inner edge and the outer edge, the coil receiving opening being substantially circular, and a second layer attached to the first layer, the second layer having a central portion extending across the coil receiving opening, an outer edge spaced from the central portion, and an extending portion connecting the central portion and the outer edge of the second layer, the central portion traversing the coil receiving opening, the outer edge of the second layer being substantially adjacent to the outer edge of the first layer; and a coil having a substantially cylindrical end extending into the coil receiving opening and abutting against a surface of the second layer that extends across the coil receiving opening and traverses the coil receiving opening.

15. A method for manufacturing a speaker, the method comprising:

mounting a diaphragm to a speaker frame, the diaphragm including a first layer having an inner edge defining a coil receiving opening, an outer edge spaced from the inner edge, and an extending portion connecting the inner edge and the outer edge, and a second layer attached to the first layer, the second layer having a central portion extending across the coil receiving opening, an outer edge spaced from the central portion, and an extending portion connecting the central portion and the outer edge of the second layer, the central portion traversing the coil receiving opening, the outer edge of the second layer being substantially adjacent to the outer edge of the first layer; and mounting a coil to the diaphragm such that an end of the coil extends into the coil receiving opening and abuts against a surface of the second layer that extends across the coil receiving opening and traverses the coil receiving opening.

* * * * *